US010581181B1

(12) United States Patent
Dix et al.

(10) Patent No.: US 10,581,181 B1
(45) Date of Patent: Mar. 3, 2020

(54) TERMINAL ASSEMBLY AND METHOD

(71) Applicant: Lear Corporation, Southfield, MI (US)

(72) Inventors: Brandon H. Dix, Livonia, MI (US); Salim A. Marouf, Ypsilanti, MI (US); Priyal N. Sheth, Dearborn, MI (US); Arindam Banerjee, Dearborn, MI (US); Sneha Agasthya, Dearborn, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/107,631

(22) Filed: Aug. 21, 2018

(51) Int. Cl.
*H01R 4/18* (2006.01)
*H01R 43/048* (2006.01)

(52) U.S. Cl.
CPC ..... *H01R 4/184* (2013.01); *H01R 43/048* (2013.01)

(58) Field of Classification Search
CPC ..... H01R 4/18; H01R 4/183; H01R 4/184; H01R 4/185; H01R 4/186; H01R 4/188; H01R 43/048
See application file for complete search history.

(56) References Cited

U.S. PATENT DOCUMENTS 2,157,007 A * 5/1939 Offner ..... H01R 4/16 439/868
3,510,824 A * 5/1970 Corns ..... H01R 4/70 29/872
3,875,662 A 4/1975 Folk
4,142,771 A 3/1979 Barnes et al.
4,246,771 A 1/1981 Covill et al.
4,831,727 A 5/1989 Johnson, Jr. et al.
4,890,384 A 1/1990 Shaffer
5,025,554 A 6/1991 Dohi
5,357,669 A 10/1994 Orphanos et al.
5,486,653 A 1/1996 Dohi
5,733,154 A 3/1998 Libregts
(Continued)

FOREIGN PATENT DOCUMENTS

JP 2009021038 A 1/2009
JP 2017111883 A 6/2017
JP 2017174689 A 9/2017

OTHER PUBLICATIONS

Co-pending U.S. application, Dix, et al., U.S. Appl. No. 16/107,080, filed Aug. 21, 2018.
(Continued)

*Primary Examiner* — Ross N Gushi
(74) *Attorney, Agent, or Firm* — Fishman Stewart PLLC

(57) ABSTRACT

A terminal assembly includes a body, a wire, a first wing extending from the body and crimped around a first portion of the wire, and a second wing extending from the body and crimped around a second portion of the wire. The second portion may extend from the first portion. The first wing may extend circumferentially around at least 50% of the first portion and/or around less than 75% of the first portion. The first wing may provide a first channel and the second wing may provide a second channel. The first portion of a wire may be disposed at least partially in the first channel. The second portion of a wire may be disposed at least partially in the second channel. The first portion and the second portion may form a loop portion of the wire that may be disposed outside of the first channel and the second channel.

20 Claims, 14 Drawing Sheets

(56) References Cited

U.S. PATENT DOCUMENTS

| | | | | |
|---|---|---|---|---|
| 6,059,616 | A | 5/2000 | Bluemmel et al. | |
| 6,109,088 | A | 8/2000 | Schrader et al. | |
| 6,334,798 | B1 | 1/2002 | Ushijima et al. | |
| 6,989,491 | B2 | 1/2006 | Triantopoulos et al. | |
| 7,044,813 | B2 | 5/2006 | Amara et al. | |
| 7,402,751 | B2 * | 7/2008 | Haberman | H01R 4/184 174/84 C |
| 7,775,842 | B2 | 8/2010 | Yamagami | |
| 7,803,008 | B2 | 9/2010 | Onuma | |
| 7,828,612 | B2 | 11/2010 | Kumakura | |
| 8,196,288 | B2 | 6/2012 | Wagner et al. | |
| 8,210,884 | B2 | 7/2012 | Corman et al. | |
| 8,221,171 | B2 | 7/2012 | Ono et al. | |
| 8,827,754 | B2 | 9/2014 | Lee et al. | |
| 8,827,756 | B2 | 9/2014 | Mueller | |
| 8,869,584 | B2 | 10/2014 | Sokol | |
| 8,900,021 | B2 | 12/2014 | Sulek et al. | |
| 9,039,467 | B2 | 5/2015 | Seipel et al. | |
| 9,787,003 | B2 | 10/2017 | Kamoshida et al. | |
| 9,853,368 | B2 | 12/2017 | Myer et al. | |
| 2005/0257592 | A1 | 11/2005 | Baker et al. | |
| 2008/0081520 | A1 | 4/2008 | Myer et al. | |
| 2013/0217279 | A1 | 8/2013 | Hemond et al. | |
| 2014/0322993 | A1 | 10/2014 | Ito | |
| 2014/0378011 | A1 | 12/2014 | Aizawa et al. | |
| 2015/0303603 | A1 * | 10/2015 | Hemond | H01R 4/188 439/878 |
| 2015/0364833 | A1 * | 12/2015 | Tonoike | H01R 4/183 439/879 |
| 2016/0087350 | A1 | 3/2016 | Yamaji et al. | |
| 2016/0240937 | A1 | 8/2016 | Matsuo | |
| 2016/0372881 | A1 | 12/2016 | Bauer et al. | |

OTHER PUBLICATIONS

Co-pending U.S. application, Dix, et al., U.S. Appl. No. 16/107,445, filed Aug. 21, 2018.

Co-pending U.S. application, Dix, et al., U.S. Appl. No. 16/107,578, filed Aug. 21, 2018.

* cited by examiner

TERMINAL ASSEMBLY AND METHOD

TECHNICAL FIELD

The present disclosure generally relates to terminals and terminal assemblies, including electrical terminals that may be used in connection with electrical wires or cables.

BACKGROUND

This background description is set forth below for the purpose of providing context only. Therefore, any aspect of this background description, to the extent that it does not otherwise qualify as prior art, is neither expressly nor impliedly admitted as prior art against the instant disclosure.

Some terminal assemblies may be relatively complex to use and/or to assemble. For example, connecting a terminal with some electrical conductors may involve a complex process and may include many different steps and components. Some terminals may not be configured for use with conductors of different sizes or conductors of different types, such as carbon nanotube or CNT, so different types of terminals may be used for various sizes or types of conductors. Additionally, conventional terminals may tend to damage or break CNT wires.

There is a desire for solutions/options that minimize or eliminate one or more challenges or shortcomings of terminals, electrical terminals, and/or terminal assemblies. The foregoing discussion is intended only to illustrate examples of the present field and should not be taken as a disavowal of scope.

SUMMARY

The foregoing and other aspects, features, details, utilities, and/or advantages of embodiments of the present disclosure will be apparent from reading the following description, and from reviewing the accompanying drawings.

In embodiments, a terminal assembly may include a body, a wire, a first wing extending from the body and crimped around a first portion of the wire, and/or a second wing extending from the body and crimped around a second portion of the wire. The second portion may extend from the first portion. The first wing may extend around at least 50% of a circumference of the first portion. The first wing may extend around less than 75% of a circumference of the first portion. The first wing may provide a first channel and the second wing may provide a second channel.

In embodiments, the first portion of a wire may be disposed partially in the first channel. The second portion of a wire may be disposed partially in the second channel. The first portion and the second portion may form a loop portion of the wire that may be disposed outside of the first channel and the second channel. The wire may be disposed at a distance from (e.g., above a bottom wall of) the body. The distance may be at least half of a diameter of the wire. The wire may be an electrical wire and/or a carbon nanotube wire. The wire may include a loop portion not in contact with the first wing, the second wing, and/or the body.

With embodiments, a method of connecting a terminal to a wire may include providing a terminal. The terminal may include a body, a first wing extending from the body, and/or a second wing extending from the body. The method may include bending the first wing and a second wing to provide a first channel and a second channel, inserting a wire in the first channel and the second channel, and/or crimping, after bending, the first wing and the second wing with the wire. The wire may be a carbon nanotube wire.

In embodiments, after bending, the first wing may include a bent portion having an angular extent of between 30 degrees and 180 degrees and/or between 90 degrees and 150 degrees. After crimping, the angular extent of the bent portion may be between 180 degrees and 270 degrees. Inserting the wire may include inserting the wire through the first channel of the first wing, then inserting the wire through the second channel of the second wing. The wire may be inserted into the first channel of the first wing in a first direction. The wire may be inserted into the second channel of the second wing in a second direction. The first direction may be opposite the second direction. The terminal may include a third wing and a fourth wing. The first wing, the second wing, the third wing, and/or the fourth wing may be bent during bending and crimped during crimping. After crimping, the wire may be disposed at a distance from the body.

DETAILED DESCRIPTION

Reference will now be made in detail to embodiments of the present disclosure, examples of which are described herein and illustrated in the accompanying drawings. While the present disclosure will be described in conjunction with embodiments and/or examples, it will be understood that they are not intended to limit the present disclosure to these embodiments and/or examples. On the contrary, the present disclosure is intended to cover alternatives, modifications, and equivalents.

Figure 1B:
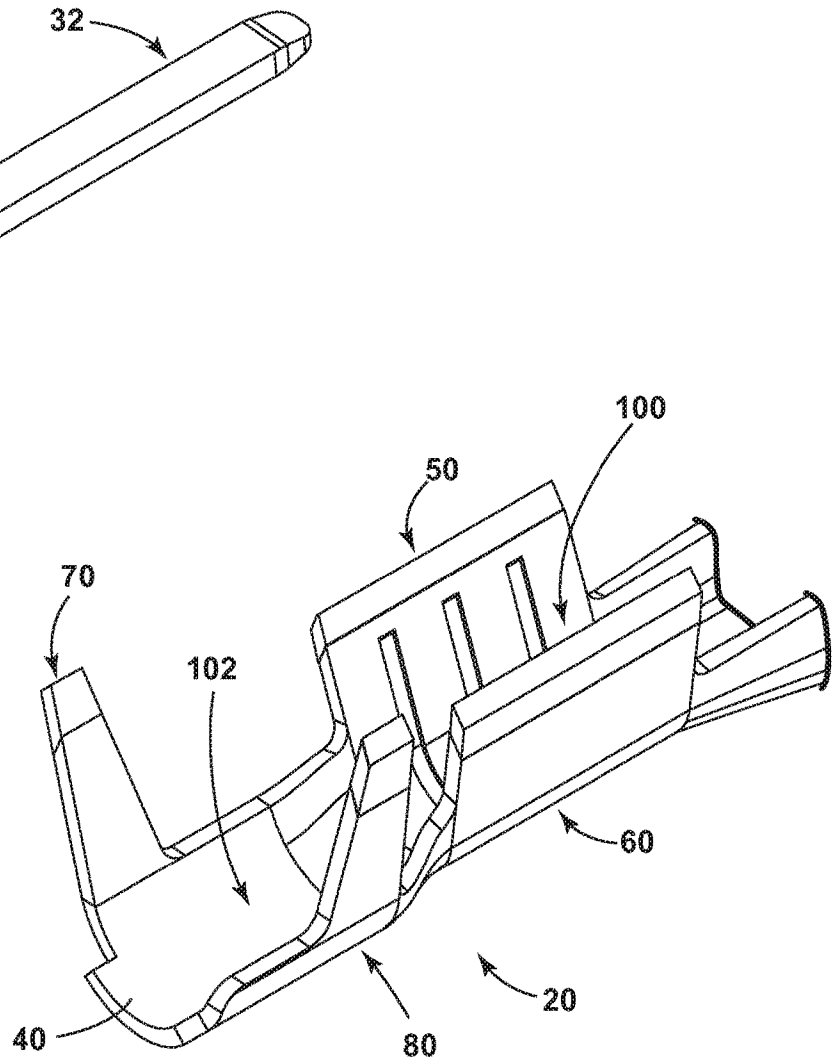
FIG. 1B is a perspective view generally illustrating portions of an embodiment of a terminal.
Figure 1A:
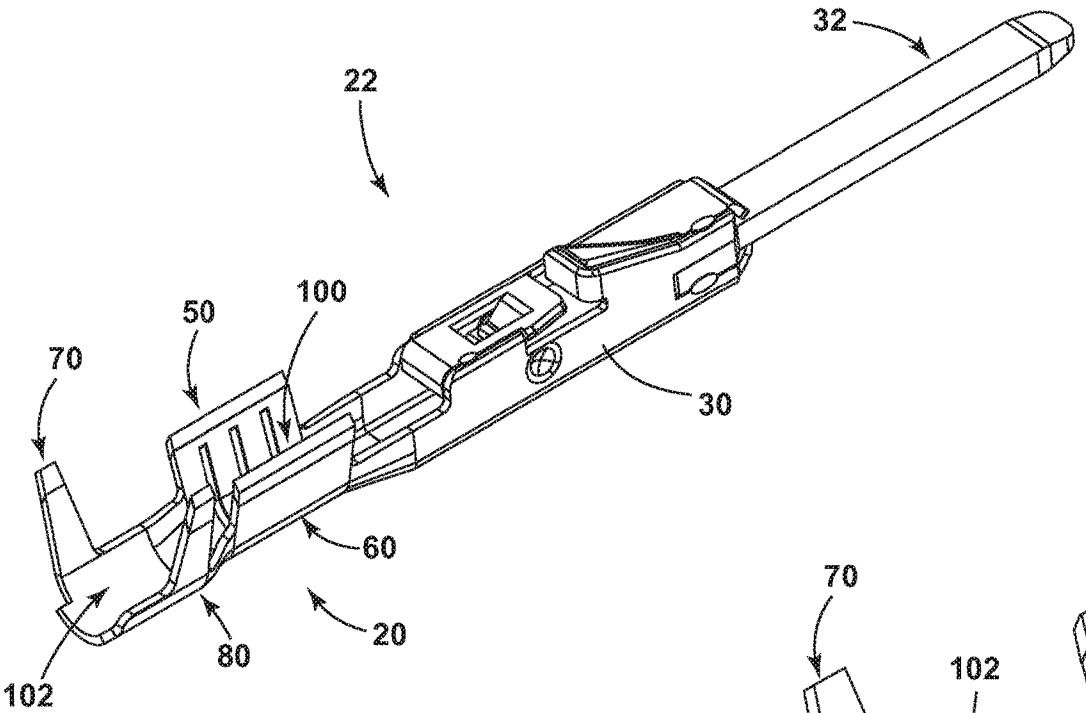
FIG. 1A is a perspective view generally illustrating portions of an embodiment of a terminal assembly.
Figure 1C:
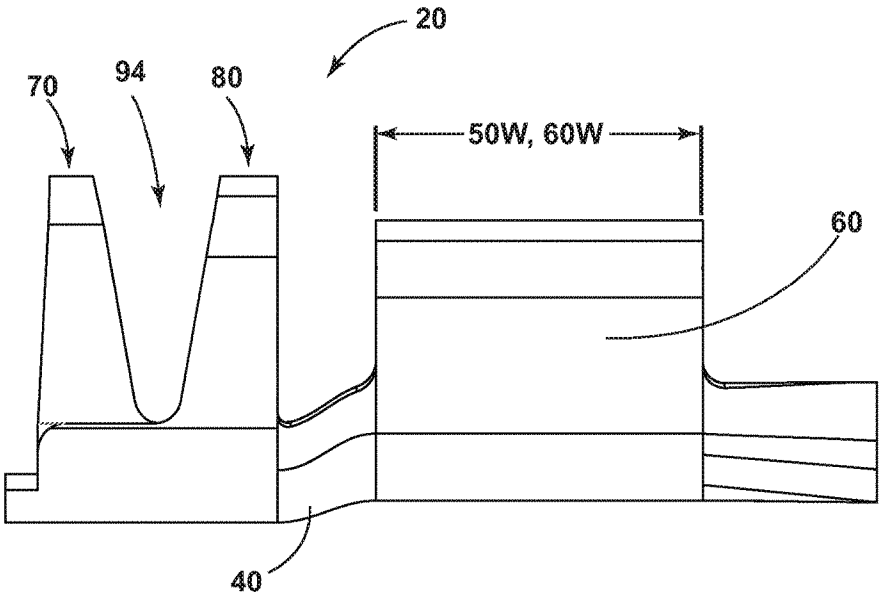
FIG. 1C is a side view generally illustrating portions of an embodiment of a terminal.
Figure 1D:
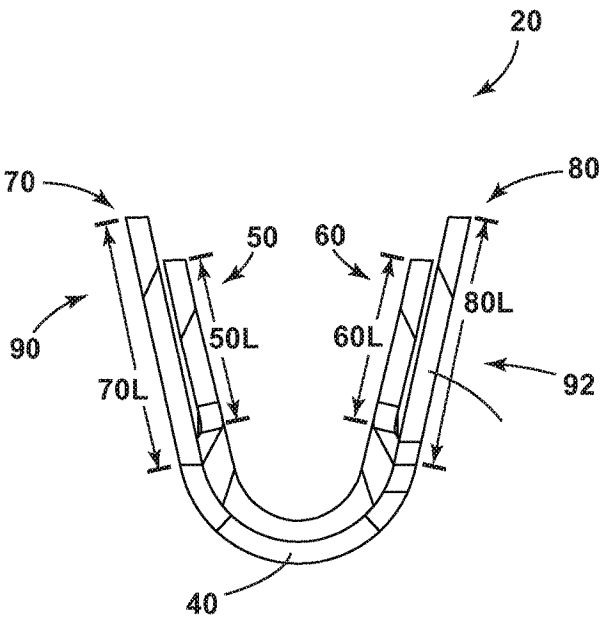
FIG. 1D is a cross-sectional view generally illustrating an embodiment of a terminal.
Figure 1E:
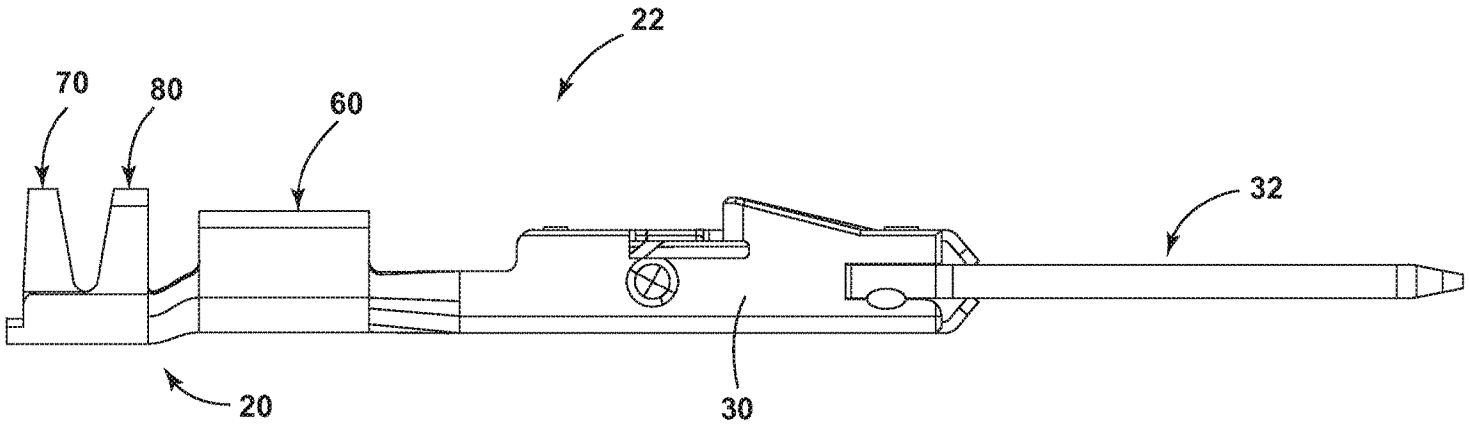
FIG. 1E is a side view generally illustrating an embodiment of a terminal assembly.
Figure 1F:
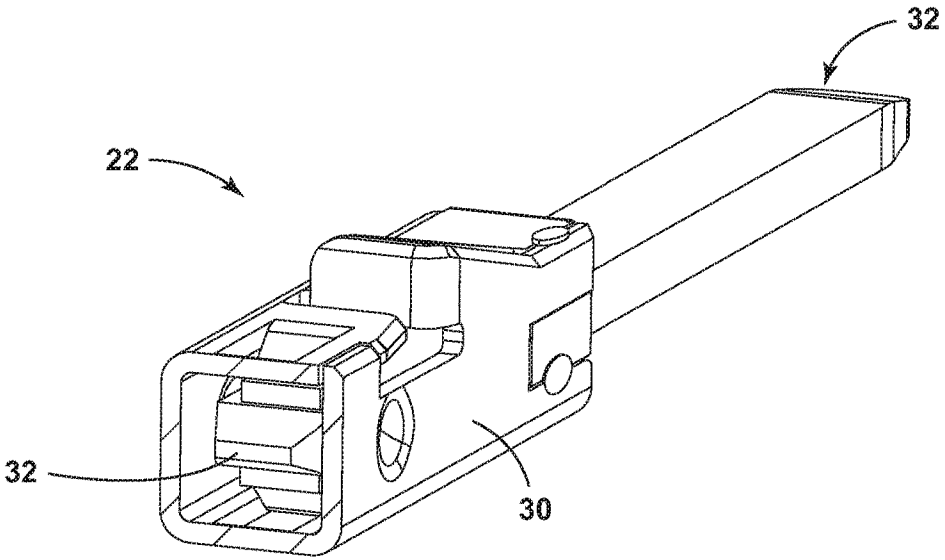
FIG. 1F is a cross-sectional perspective view generally illustrating portions of an embodiment of a terminal assembly.

In embodiments, a terminal assembly 22 may include a terminal 20 and a wire 24. With embodiments, such as generally illustrated in FIG. 1A, a terminal 20 may include and/or be connected to a receiving portion 30. The receiving portion 30 may be configured to receive a male terminal or pin 32. The terminal 20 may be configured to retain a wire 24. The wire may, for example and without limitation, be a carbon nanotube wire.

With embodiments, such as generally illustrated in FIGS. 1A, 1B, 1C, 1D, 1E, and 1F, the terminal 20 may include a terminal body portion 40, a first wing 50, and/or a second wing 60. A terminal 20 may include one or more of a variety of shapes, sizes, and/or configurations. For example and without limitation, the terminal 20 may be substantially U-shaped and/or V-shaped (e.g. before bending and/or before crimping).

In embodiments, a terminal body portion 40, a first wing 50, and/or a second wing 60 may include respective inner surfaces and outer surfaces. The terminal wings 50, 60 may be substantially planar. With embodiments, a terminal 20 may include a third wing 70 and/or a fourth wing 80. The first wing 50, the second wing 60, the third wing 70, and/or the fourth wing 80 may extend outward (e.g., vertically and/or laterally) from the terminal body portion 40. The first wing 50, the second wing 60, the third wing 70, and/or the fourth wing 80 may or may not extend at substantially the same angle (e.g., oblique and/or right angles) from the terminal body 40. The first wing 50 and the second wing 60 may extend at the same angle in opposite directions relative to the vertical direction.

With embodiments, the first wing 50 and the third wing 70 may extend from a first side 90 of the terminal body portion 40, and/or the second wing 60 and the fourth wing 80 may extend from a second side 92 of the terminal body portion 40. In embodiments, the first wing 50 and the second wing 60 may be disposed opposite each other, and/or the third wing 70 and the fourth wing 80 may be disposed opposite each other. With embodiments, the first wing 50 and the second wing 60 may extend generally in a vertical direction V and may include lengths 50L, 60L, which may or may not be the same. The third wing 70 and the fourth wing 80 may extend generally in the vertical direction V and include lengths 70L, 80L, which may or may not be the same. The lengths 50L, 60L may be different than the lengths 70L, 80L (e.g., shorter or longer). In embodiments, the first wing 50 and the second wing 60 may include widths 50W, 60W (e.g., relative to a longitudinal direction L), which may or may not be the same.

In embodiments, the third wing 70 and/or the fourth wing 80 may be offset (e.g., not disposed directly across from each other). For example and without limitation, the third wing 70 may be disposed farther from the first wing 50 and/or the second wing 60 than the fourth wing 80. With embodiments, there may be a gap 94 (e.g., in the longitudinal direction L) between the third wing 70 and the fourth wing 80.

With embodiments, the first wing 50 may be configured to retain a first portion 24A of a wire 24 and/or the second wing 60 may be configured to retain a second portion 24B of the wire 24. The third wing 70 and the fourth wing 80 may be configured to retain a third portion 24C and a fourth portion 24D of the wire 24.

Figure 2:
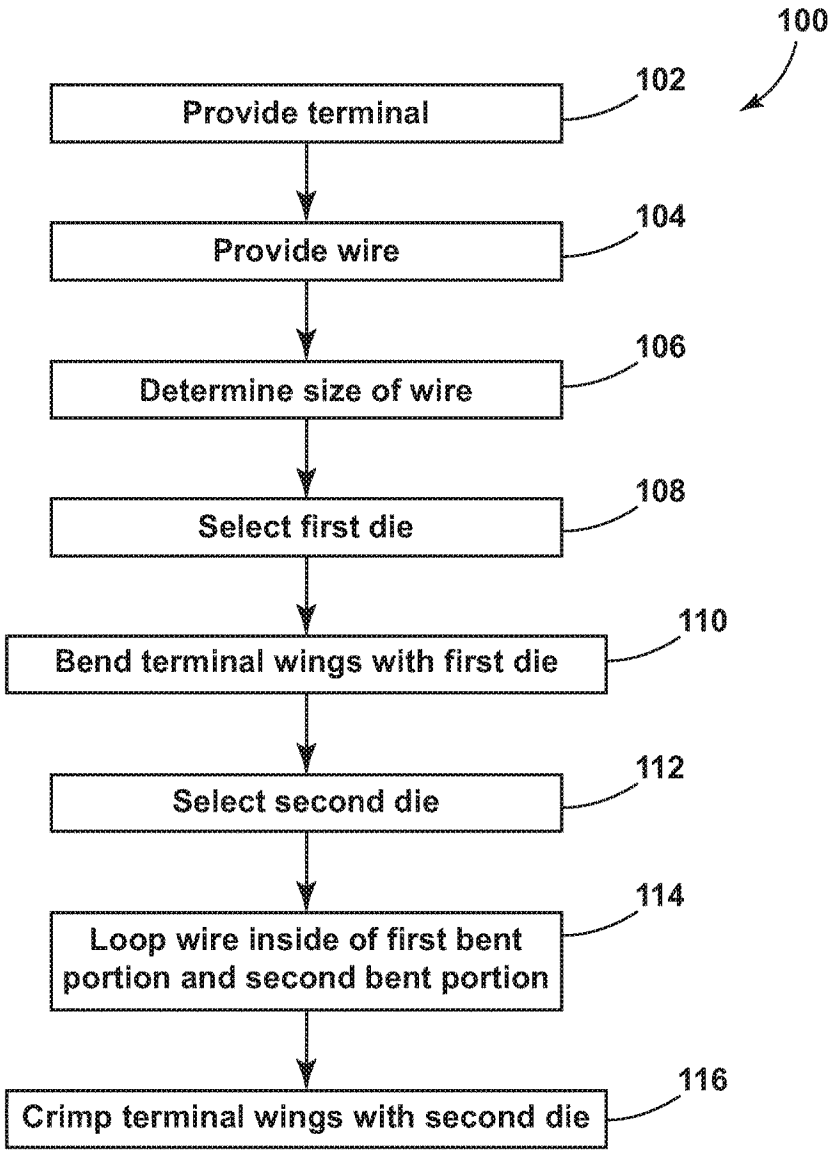
FIG. 2 is a flowchart generally illustrating an embodiment of a method of assembling a terminal assembly.

In embodiments, such as generally illustrated in FIG. 2, a method 100 of assembling a terminal assembly 22 may include providing a terminal 20 (step 102), providing a wire 24 (step 104), determining the size of the wire 24 (step 106), and/or selecting a first/bending die 130 (step 108). The method 100 may include bending one or more of the terminal wings 50, 60, 70, 80 via the first die 130 (step 110).

Figures 4A, 4B:
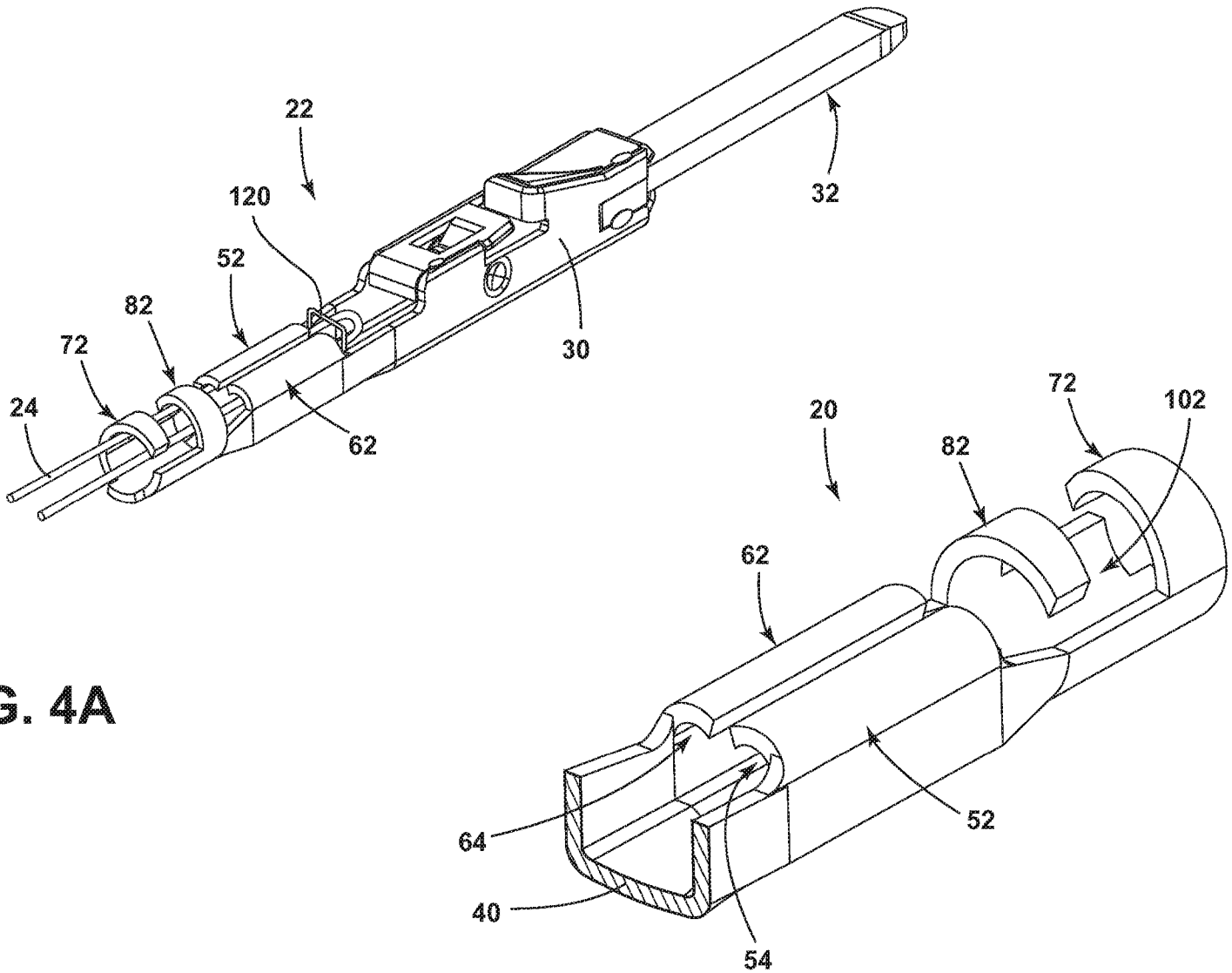
FIG. 4A is a perspective view generally illustrating portions of an embodiment of a terminal assembly after bending.
FIG. 4B is a perspective view generally illustrating portions of an embodiment of a terminal after bending.
Figure 4C:
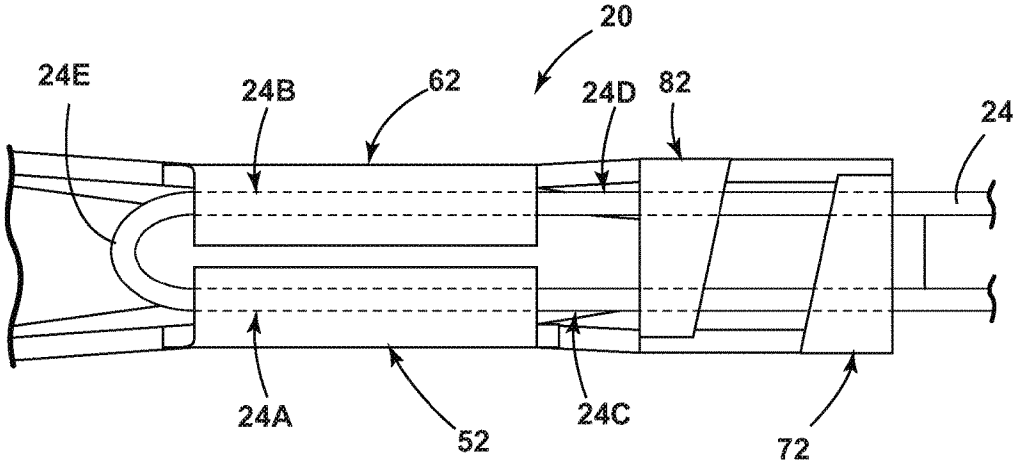
FIG. 4C is a top view generally illustrating portions of an embodiment of a terminal assembly after bending.

Bending the first wing 50 may include forming a bent portion 52 of the first wing 50 (see, e.g., FIGS. 4A, 4B and 4C). The bent portion 52 may define a first channel 54. Bending the second wing 60 may include forming a bent portion 62 of the second wing 60. The bent portion may define a second channel 64. The bent portions 52, 62 may be curved and/or arcuate. After bending, angular extents $\alpha_1$, $\alpha_2$ of the bent portion 52 and/or the bent portion 62 may, for example and without limitation, be at least 30 degrees, at least 90 degrees, less than 270 degrees, less than 180 degrees, between 90 degrees and 180 degrees, and/or between 90 degrees and 150 degrees, among others. Bending the third wing 70 may include forming a bent portion 72 of the third wing 70. Bending the fourth wing 80 may include forming a bent portion 82 of the fourth wing 80.

With embodiments, the method 100 may include selecting a second/crimping die 170 (step 112). The method 100 may include inserting a wire 24 into the first channel 54 and/or the second channel 64 (step 114). For example and without limitation, a first portion 24A of the wire may be inserted into the first channel 54 and/or a second portion 24B of the wire 24 may be inserted into the second channel 64.

In embodiments, the method 100 may include crimping the terminal 20 (e.g., the terminal wings 50, 60, 70, 80, and/or the bent portions 52, 62, 72, 82) via the second die 170 (step 116).

With embodiments, as an alternative to selecting a second die in step 112, the terminal 20 may be bent (step 110) and crimped (step 116) with the same die (e.g., first die 130). The first die 130 may bend the terminal 20 to a certain degree while bending (step 110), and the first die 130 may bend the terminal further while crimping (step 116).

Figure 4D:
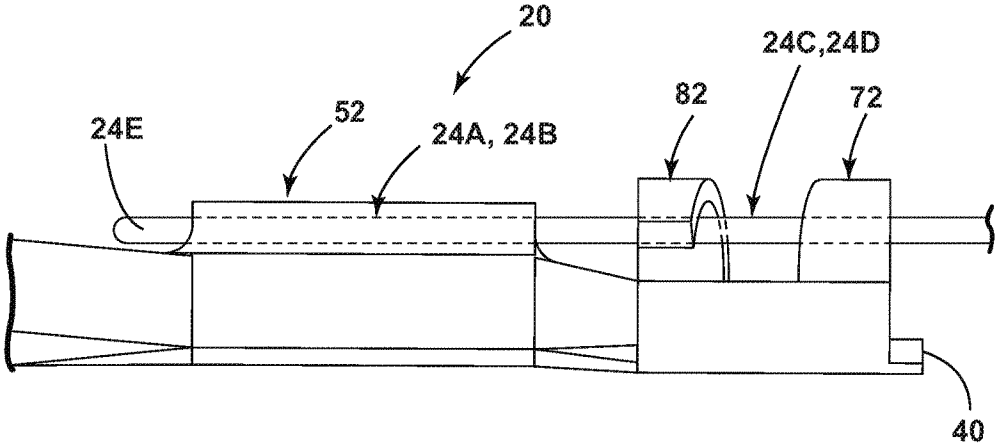
FIG. 4D is a side view generally illustrating portions of an embodiment of a terminal assembly after bending.
Figure 4E:
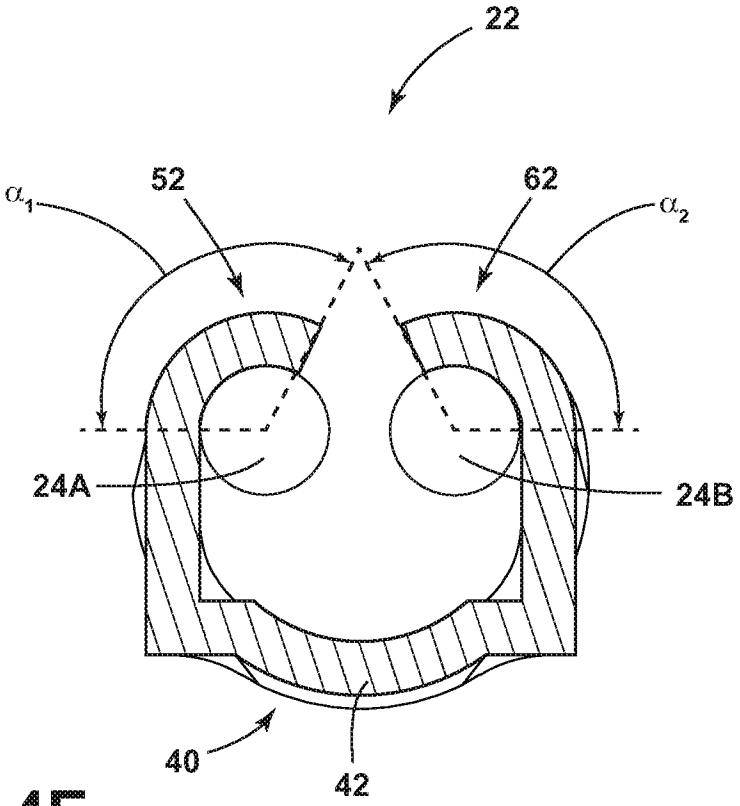
FIG. 4E is a cross-sectional view generally illustrating portions of an embodiment of a terminal assembly after bending.

In embodiments, bending a terminal 20 (e.g., in step 110) may include moving one or more portions of a bending die 130 in a first direction and crimping the terminal 20 may include moving one or more portions of a crimping die 170 in the first direction. With embodiments, crimping one or more of the terminal wings 50, 60, 70, 80 may include crimping the first wing 50 with a first portion 24A of the wire 24, crimping the second wing 60 with a second portion 24B of the wire, crimping the third wing 70 with a third portion 24C of the wire 24, and/or crimping the fourth wing 80 with a fourth portion 24D of the wire 24 (e.g., see FIGS. 4C and 4D).

In embodiments, the terminal 20 may include a first state, a second state, and/or a third state. In the first state, the terminal 20 may not be crimped, shortened, altered, and/or bent (e.g., see FIGS. 1A-1F). In the second state, at least a portion of the terminal 20 may be bent (e.g., see FIGS. 4A-4E). For example and without limitation, the ends of the first wing 50, the second wing 60, the third wing 70, and/or the fourth wing 80 may be bent inwards towards a center of the terminal body portion 40. In the third state, the terminal 20 may be crimped onto/with a wire 24 (e.g., see FIGS. 6A-6D). In embodiments, a first die 130 may be configured to bend a portion of the terminal 20. The terminal 20 may transition from the first state to the second state via the first die 130. A second die 170 and/or the first die 130 may crimp the terminal 20. With embodiments, the terminal 20 may transition from the second state to the third state via the first die 130 and/or the second die 170.

With embodiments, in a bent state, an end of a wing 50, 60, 70, 80 may or may not be in contact other portions of the wing 50, 60, 70, 80 and/or in contact with the terminal body portion 40. The first wing 50 and/or the second wing 60 may be bent to at least somewhat beyond horizontal, which may facilitate at least temporary retaining or holding of a wire 24. The first wing 50 and/or the second wing 60 may be bent at least 90 degrees inward relative to the first state. The third wing 70 and/or the fourth wing 80 may bent at least 90 degrees inward relative to the first state. The third wing 70 and/or fourth wing 80 may be bent to be disposed substantially horizontal (e.g., or past horizontal).

Figure 3A:
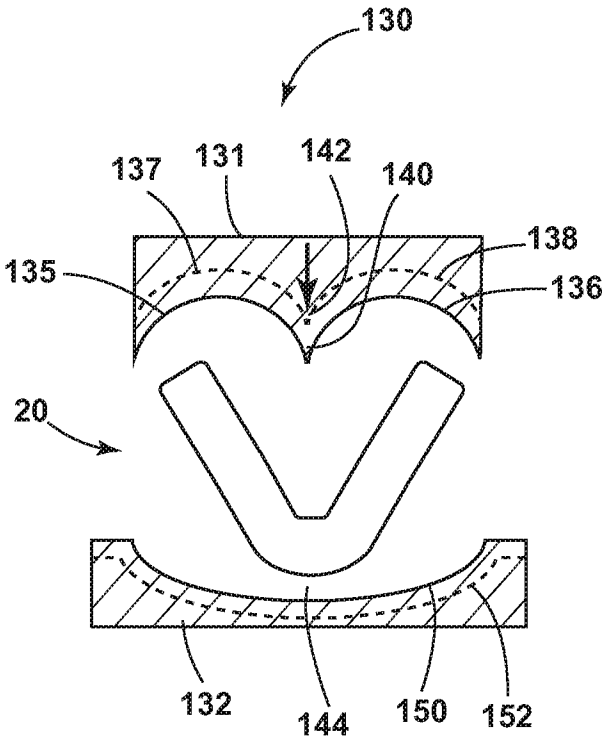
FIG. 3A is a cross-sectional view generally illustrating portions of an embodiment of a terminal and die.
Figure 3C:
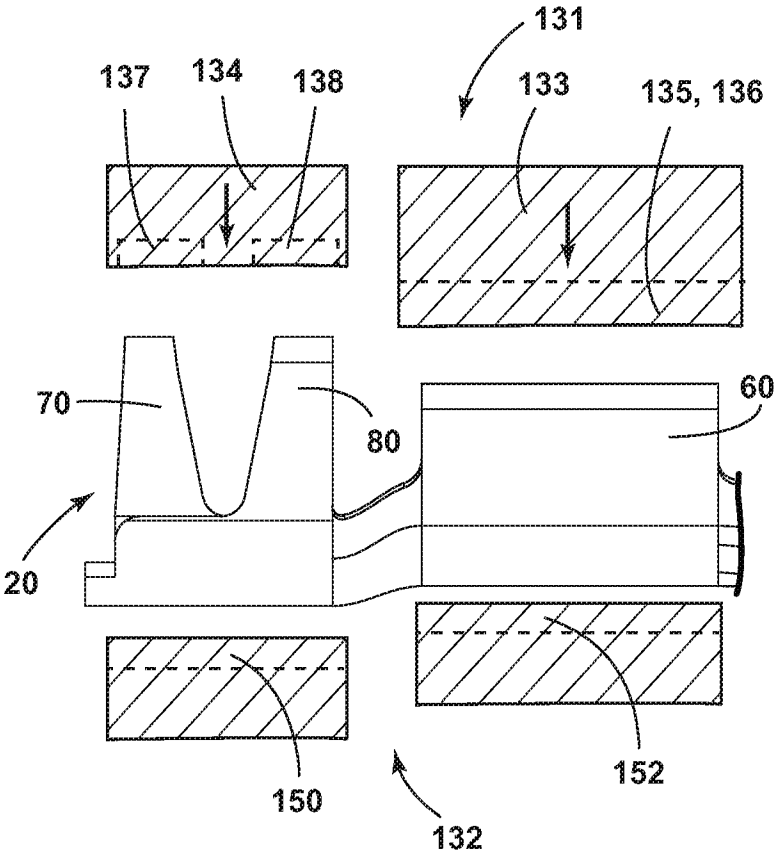
FIGS. 3B and 3C are side views generally illustrating portions of embodiments of terminals and dies.
Figure 3B:
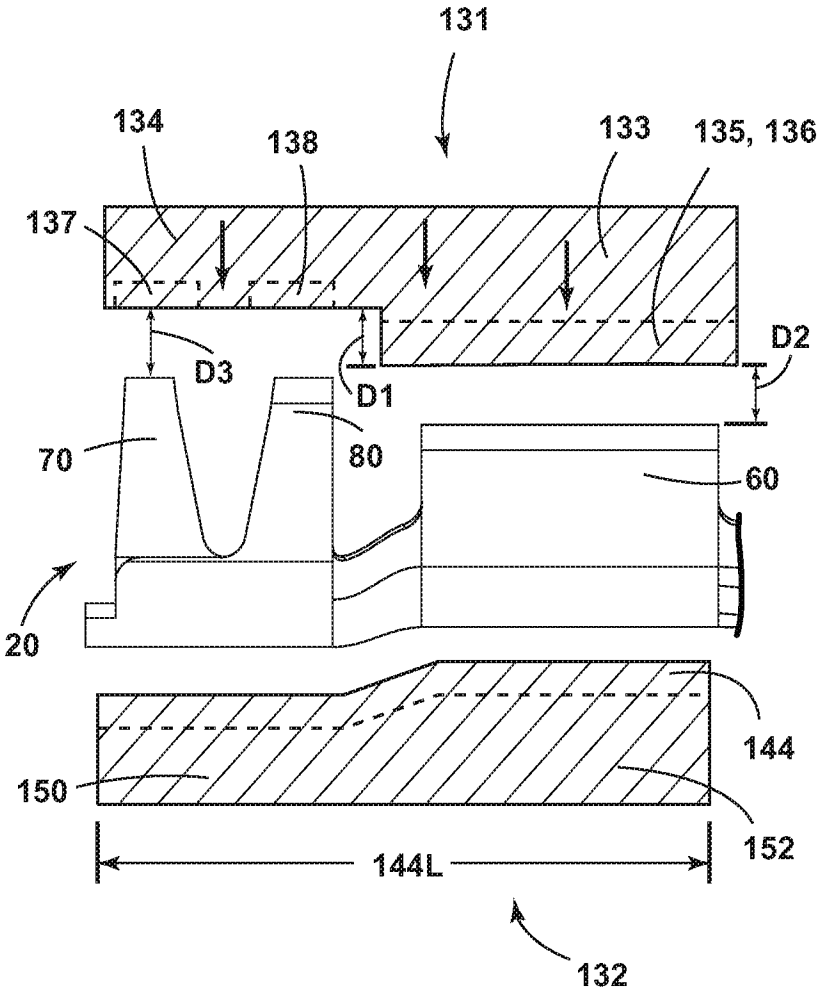

In embodiments, such as generally illustrated in FIGS. 3A, 3B, and 3C, bending a terminal 20 (e.g., step 110 of method 100) may include bending a terminal 20 via a first die 130 (e.g., a bending die). The first die 130 may include a top portion 131 and a bottom portion 132. The top portion 131 may be disposed substantially parallel to the bottom portion 132.

With embodiments, the top portion 131 may be disposed proximate the ends of the wings 50, 60, 70, 80. The bottom portion 132 may be disposed proximate the terminal body portion 40. In embodiments, the top portion 131 of the first die 130 may include a first bending portion 133 and a second bending portion 134 (see, e.g., FIGS. 3B and 3C). As generally illustrated in FIG. 3B, the first bending portion 133 may be formed with the second bending portion 134 as a single piece. Alternatively, as generally illustrated in FIG. 3C, the first bending portion 133 may be independent from the second bending portion 134 (e.g., the first bending portion 133 and the second bending portion 134 may be separate pieces that may be independently movable). In embodiments, the first bending portion 133 may be configured to bend the first wing 50 and the second wing 60, and/or the second bending portion 134 may be configured to bend the third wing 70 and the fourth wing 80. The first bending portion 133 may be vertically offset by a distance $D_1$ from the second bending portion 134, such as to compensate for different lengths of the first wing 50 and the second wing 60 relative to the third wing 70 and the fourth wing 80. In an initial/non-bending position, a first bending portion 133 may be disposed at a distance $D_2$ from the first wing 50 and/or the second wing 60. In an initial/non-bending position, the second bending portion 134 may be disposed at a distance $D_3$ from the third wing 70 and/or fourth wing 80. Distances $D_2$, $D_3$ may or may not be substantially the same.

With embodiments, a first die top portion 131 may include a first recess 135 and/or a second recess 136. The first recess 135 and/or a second recess 136 may receive at least a portion of the wings 50, 60, 70, 80. The first recess 135 and/or the second recess 136 may include one or more of a variety of shapes, sizes, and/or configurations. For example and without limitation, the first recess 135 and/or a second recess 136 may be substantially oval-shaped and/or generally rounded. A first recess 135 and/or a second recess 136 may open downward and/or to a bottom of the first die 130. In embodiments, the first recess 135 and the second recess 136 may be configured to bend the wings 50, 60 to create bent portions 52, 62.

In embodiments, the first die top portion 131 may include a third recess 137 and/or a fourth recess 138. The third recess 137 and the fourth recess 138 may be configured to bend the wings 70, 80 (e.g., simultaneously) to create bent portions 72, 82. With embodiments, the first recess 135 may contact the first wing 50, the second recess 136 may contact the second wing 60, the third recess 137 may contact the third wing 70, and/or the fourth recess 138 may contact the fourth wing 80 (e.g., simultaneously). The recesses 135, 136, 137, 138 may be substantially similar or the same shape and/or size. In embodiments, the first recess 135 and the second recess 136 may be disposed at a different distance from the terminal body portion 40 than the third recess 137 and the fourth recess 138. In embodiments, the first recess 135 and/or the second recess 136 may be formed into the same side (e.g., a bottom side) of the top portion 131.

With embodiments, a top portion 131 of a first die 130 may include a first protrusion 140 and/or a second protrusion 142. The protrusions 140, 142 (see, e.g. FIG. 3A) may include one or more of a variety of shapes, sizes, and/or configurations. For example and without limitation, the protrusions 140, 142 may have a bottom surface that may be substantially pointed. With embodiments, the protrusions 140, 142 may be disposed between recesses 135, 136, 137, 138. For example, the first protrusion 140 may be disposed between (e.g., in a transverse direction T) the first recess 135 and the second recess 136, and/or the second protrusion 142 may be disposed between the third recess 137 and the fourth recess 138. The protrusions 140, 142 may guide movement of the wings 50, 60, 70, 80 towards each other and/or the center of the terminal body portion 40 during bending, such as to facilitate insertion of wire 24 into the first channel 54 and/or the second channel 64 after bending and prior to crimping (step 114 of method 100).

In embodiments, the first die bottom portion 132 may include a channel 144. The channel 144 may include one or more of a variety of shapes, sizes, and/or configurations. For example and without limitation, the channel 144 may be substantially U-shaped, V-shaped, oval-shaped, and/or rounded. The channel 144 may retain a terminal 20 during bending. The channel 144 may extend in a longitudinal direction L, such as from a first end of the bottom portion 132 to a second end of the bottom portion 132. The first end may be opposite the second end. The channel 144 may include a length 144L (e.g., in the longitudinal direction) that may be longer or shorter than the terminal 20, or the length 144L may be substantially the same as a length of the terminal 20.

In embodiments, the channel 144 may include a first portion 150 and/or a second portion 152. The second portion 152 may be wider than the first portion 150. In embodiments, the second portion 152 may be configured to retain (e.g., restrict movement in at least one direction) the terminal body portion 40 at or about the third wing 70 and the fourth wing 80. The first portion 150 may be configured to retain the terminal body portion 40 at or about the first wing 50 and the second wing 60. With embodiments, such as generally illustrated in FIG. 3A, in an initial/pre-bending position of the terminal 20, the channel 144 may be configured to contact the terminal 20 along an inner surface of the channel 144 (e.g., substantially all of the inner surface).

In embodiments, such as generally illustrated in FIGS. 4A, 4B, 4C, 4D, and 4E, wings 50, 60, 70 80 may be bent to form bent portions 52, 62, 72, 82. A bending die top portion 131 may be pressed (e.g. in a downward direction) onto the terminal 20, such as while the bending die bottom portion 132 supports the terminal 20 from the opposite direction, to form bent portions 52, 62, 72, 82. Some or all of the bent portions 52, 62, 72, 82 may each include a generally C-shaped configuration after bending. In embodiments, such as generally illustrated in FIG. 4A, a terminal 20 may include a shield or barrier 120 that may be configured to shield or protect a wire 24 (e.g. a CNT wire) from edges of the wings 50, 60 that may be sharp and could damage the wire 24. The shield 120 may include a rectangular configuration that may be configured to conform with the wings 50, 60.

With embodiments, bending a terminal 20 may include the first recess 135 contacting the first wing 50 and/or bending the first wing 50 to form a bent portion 52. Bending the first wing 50 may include bending an end of the first wing 50 about 90 degrees (e.g., the end may be disposed substantially vertical before bending, and the end may be disposed substantially horizontal after bending). With embodiments, the end may be bent downward (e.g., toward body portion 40), at least to some degree.

In embodiments, bending a terminal 20 may include the second recess 136 contacting the second wing 60 and/or bending an end of the second wing 60 to form a second bent portion 62. Bending the second wing 60 may include bending the end of the second wing 60 about 90 degrees (e.g., the end may be disposed substantially vertical before bending, and the end may be disposed substantially horizontal after bending). With embodiments, the end of the second wing 60 may be partially bent downward, at least to some degree.

With embodiments, bending a terminal 20 may include the third recess 137 contacting the third wing 70 and/or bending an end of the third wing 70 to form a third bent portion 72. Bending the third wing 70 may include bending the end about 90 degrees (e.g., the end may be disposed substantially vertical before bending and may be disposed substantially horizontal after bending). With embodiments, the end may be bent downward, at least to some degree.

In embodiments, bending a terminal 20 may include the fourth recess 138 contacting the fourth wing 80 and/or bending an end of the fourth wing 80 to form a fourth bent portion 82. Bending the fourth wing 80 may include bending the end about 90 degrees (e.g., the end may be disposed substantially vertical before bending and may be disposed substantially horizontal after bending). With embodiments, the end may be bent downward, at least to some degree.

In embodiments, during bending, the wings 50, 60, 70, 80 may first contact the outer portions of the recesses 135, 136, 137, 138. As the top portion 131 and the bottom portion 132 of the first die 130 move together, the wings 50, 60, 70, 80 may move from contacting the outer portions to contacting the inner portions of the recesses 135, 136, 137, 138. With embodiments, as the end portions of the wings 50, 60, 70, 80 move from contacting the outer portions to contacting the inner portions, the first die 130 may cause the end portions the wings 50, 60, 70, 80 to bend, which may result in/form bent portions 52, 62, 72, 82.

In embodiments, a wire 24 may be inserted into the terminal 20 after bending (e.g. in step 114). The wire 24 may be looped around and/or inside the bent portions 52, 62. The wire 24 may wrap around an end of the first bent portion 52 and/or second bent portion 62 (e.g., such as to retain the wire prior to crimping). The wire 24 may be substantially disposed under and/or inside the first bent portion 52, the second bent portion 62, the third bent portion 72, and/or the fourth bent portion 82. The bent portions 52, 62 may be sufficiently bent as to secure the wire 24, at least to some degree. The wire 24 may be inserted from a first direction while into the first bent portion 52, and/or the wire 24 may be inserted from a second direction into the second bent portion 62. In embodiments, the wire 24 may be inserted vertically into the terminal 20 (e.g., inserted from above), and/or the wire may be inserted longitudinally (e.g., parallel to the terminal), such as through the first channel 54 and then through the second channel 64.

In embodiments, a third state of the terminal 20 may include the terminal 20 being crimped with a wire or cable 24 (e.g., a CNT wire), such as after bending. The terminal 20 may be crimped with a wire 24 via the first die 130 and/or the second die 170. The second die 170 may include a top portion 171 and a bottom portion 172. The top portion 171 may be disposed substantially parallel to the bottom portion 172. The second die 170 may be substantially similar to the first die and/or may include similar characteristics. In other embodiments, the first die 130 may be used to crimp the terminal instead of a second die 170. The terminal 20 may be bent and crimped by a single die.

Figure 5A:
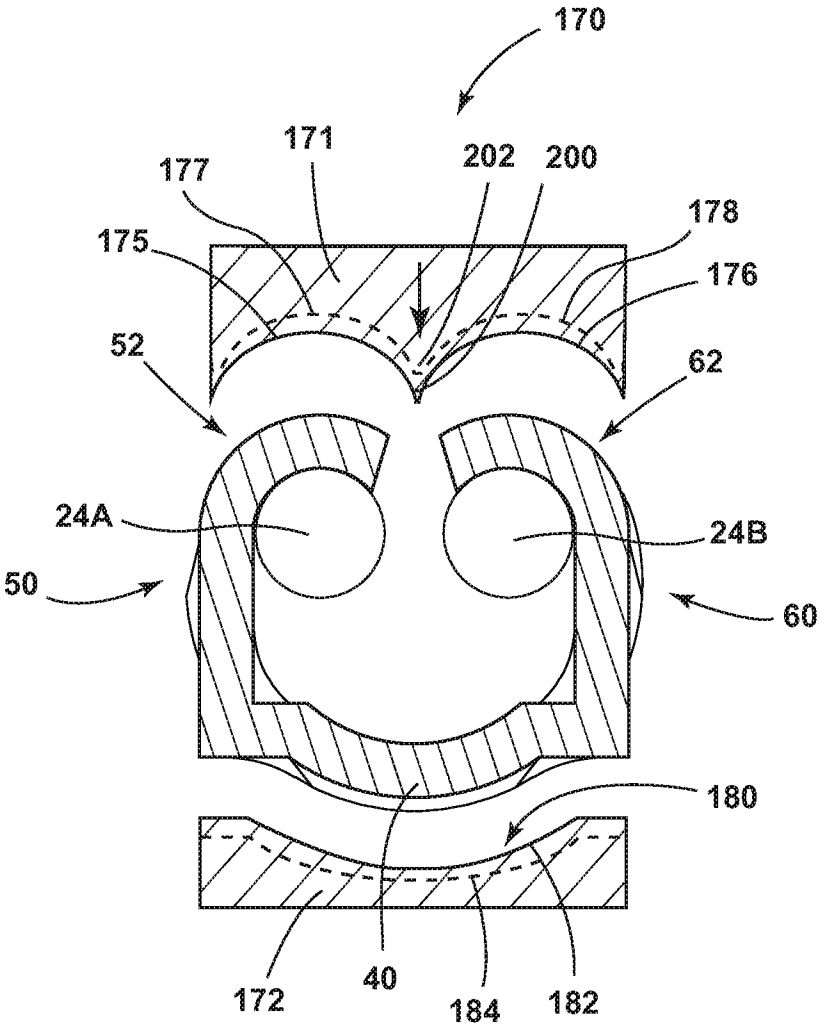
FIG. 5A is a cross-sectional view generally illustrating portions of an embodiment of a terminal and die after bending.
Figure 5C:
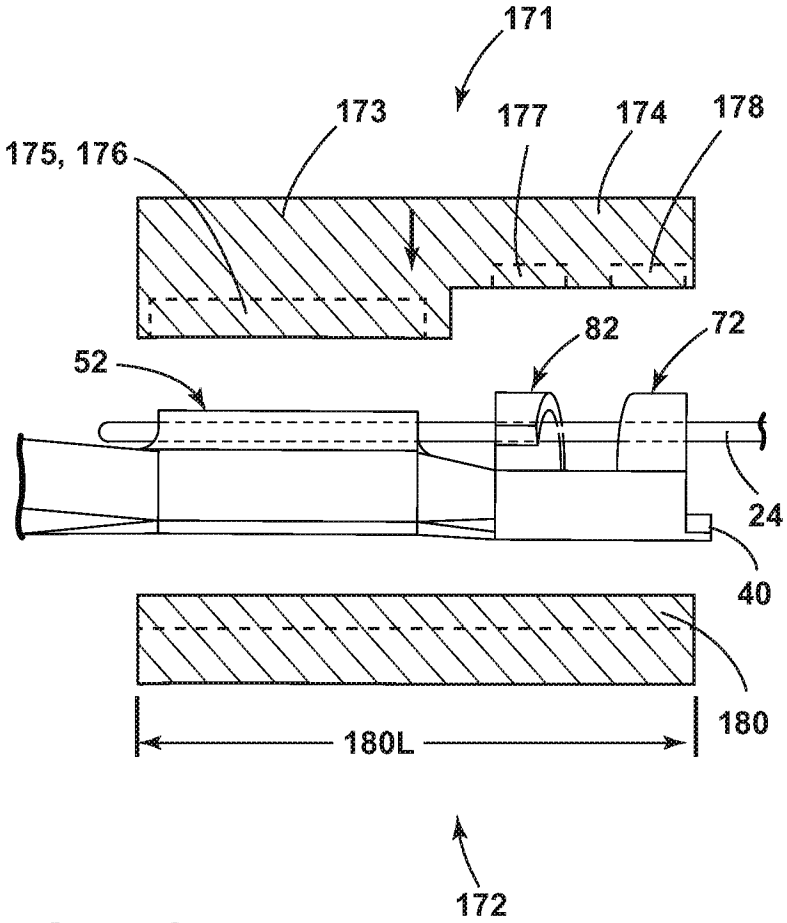
FIGS. 5B and 5C are side views generally illustrating portions of embodiments of terminals and dies.
Figure 5B:
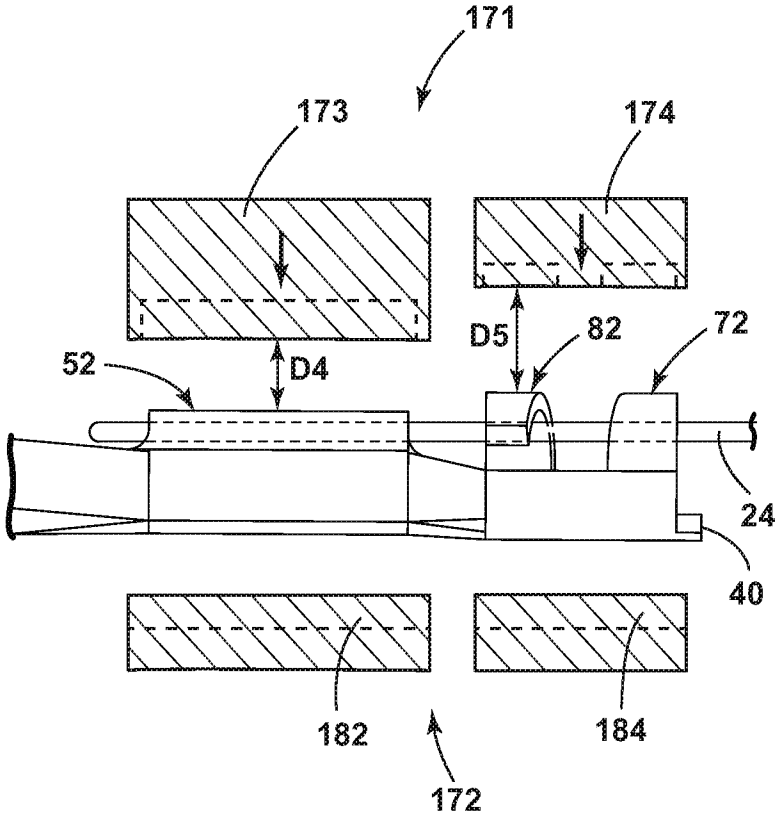

With embodiments, such as generally illustrated in FIGS. 5A, 5B, and 5C, prior to crimping, the top portion 171 may be disposed proximate the bent portions 52, 62, 72, 82 of the wings 50, 60, 70, 80, and/or the bottom portion 172 may be disposed proximate the terminal body portion 40. In embodiments, the top portion 171 may include a first crimp portion 173 and a second crimp portion 174. The first crimp portion 173 may be formed with the second crimp portion 174 as a single piece. Alternatively, the first crimp portion 173 may be independent from the second crimp portion 174 (e.g., may be separate, independently movable pieces). Prior to crimping, the first crimp portion 173 may be disposed proximate the first bent portion 52 and the second bent portion 62, and/or the second crimp portion 174 may be disposed proximate the third bent portion 72 and the fourth bent portion 82. A first crimp portion 173 may be disposed at a distance $D_4$ from the first bent portion 52 and second bent portion 62, and the second crimp portion 174 may be disposed at a distance $D_5$ from the third bent portion 72 and the fourth bent portion 82 (see, e.g., FIGS. 5B and 5C). Distances $D_4$, $D_5$ may or may not be substantially the same.

With embodiments, the first crimp portion 173 may include a first recess 175, and/or a second recess 176. The first crimp portion 173 may include a first protrusion 200 between the first recess 175 and the second recess 176. The second crimp portion 174 may include a third recess 177 and/or a fourth recess 178. The second crimp portion 174 may include a second protrusion 202 that may be disposed between the third recess 177 and the fourth recess 178. The first protrusion 200 and the second protrusion 202 may include one or more of a variety of shapes, sizes, and/or configuration. For example and without limitation, the first and second protrusions 200, 202 may be substantially triangle-shaped and/or pointed.

In embodiments, the recesses 175, 176, 177, 178 may include one or more of a variety of shapes, sizes, and/or configurations. For example and without limitation, the recesses 175, 176, 177, 178 may be substantially oval-shaped, half circle-shaped, and/or generally rounded. The recesses 175, 176, 177, 178 may or may not be substantially similar to each other and may include substantially the same shape and/or size. In embodiments, the first recess 175 and the second recess 176 may be disposed at a different distance from the terminal body portion 40 (e.g., at a different height) than the third recess 177 and the fourth recess 178, such as to compensate for different lengths 50L, 60L of the first wing 50 and the second wing 60 relative to the lengths 70L, 80L of the third wing 70 and the fourth wing 80. The first recess 175 and the second recess 176 may be disposed at the same distance from the first bent portion 52 and the second bent portion 62 as the third recess 177 and the fourth recess 178 may be disposed from the third bent portion 72 and the fourth bent portion 82.

In embodiments, such as generally illustrated in FIGS. 5A, 5B, and 5C, the second die bottom portion 172 may include a channel 180. The channel 180 may include one or more of a variety of shapes, sizes, and/or configurations. For example and without limitation, the channel 180 may be substantially U-shaped, V-shaped, oval-shaped, and/or rounded. In embodiments, the channel 180 may retain (e.g., limit movement in at least one direction) a terminal 20 during crimping. For example and without limitation, the channel 180 may retain the terminal body portion 40 and/or portions of the first wing 50, second wing 60, third wing 70, and fourth wing 80. The channel 180 may extend in a longitudinal direction L, such as from a first end of the bottom portion 172 to a second end of the bottom portion 172. The first end may be opposite the second end. The channel 180 may include a length 180L (e.g., in the longitudinal direction) that may be longer or shorter than the terminal 20, or the length 180L may be substantially the same as a length of the terminal 20.

In embodiments, the channel 180 may include a first portion 182 and/or a second portion 184. The second portion 184 may be wider than the first portion 182. In embodiments, the first portion 182 may be configured to retain (e.g., restrict movement in at least one direction) the terminal body portion 40 at or about the first wing 50 and the second wing 60. The second portion 184 may be configured to retain the terminal body portion 40 at or about the third wing 70 and the fourth wing 80. With embodiments, such as generally illustrated in FIG. 5A, in an initial/pre-crimping position of the terminal 20, the channel 180 may be configured to contact the terminal 20 along an inner surface of the channel 180 (e.g., substantially all of the inner surface). In embodiments, the channel 180 may be wider than the terminal 20 and the terminal may contact only portions of the inner surface of the channel 180.

Figure 6A:
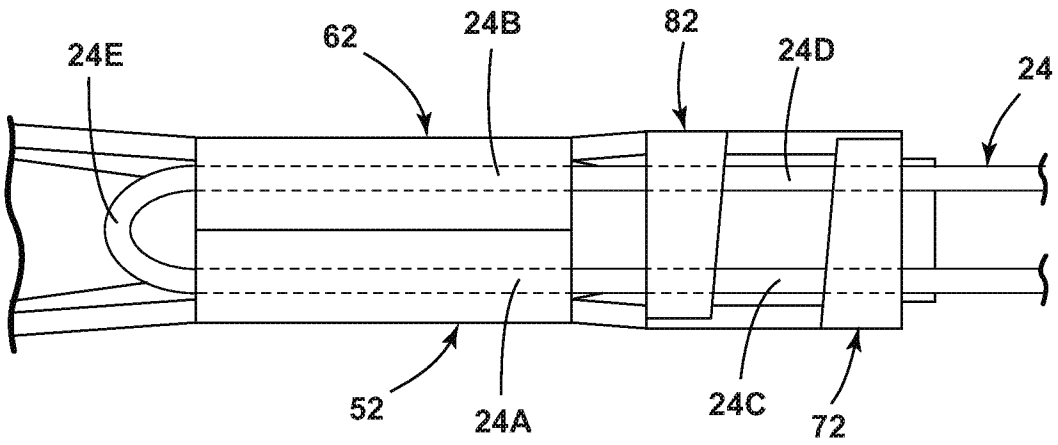
FIG. 6A is a top view generally illustrating portions of an embodiment of a terminal assembly after crimping.
Figure 6B:
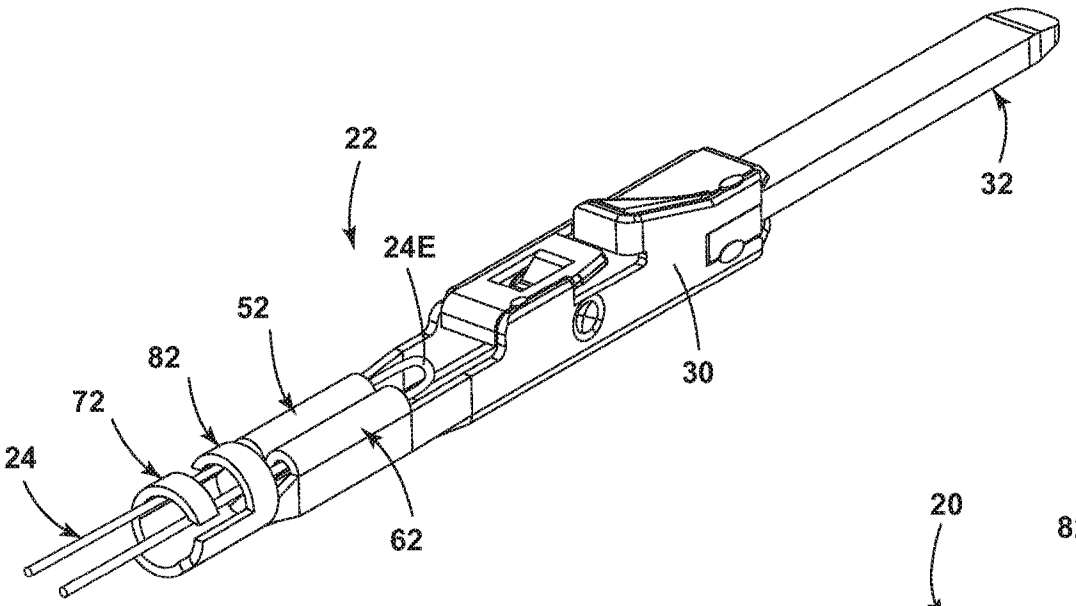
FIG. 6B is a perspective view generally illustrating portions of an embodiment of a terminal assembly after crimping.
Figure 6C:
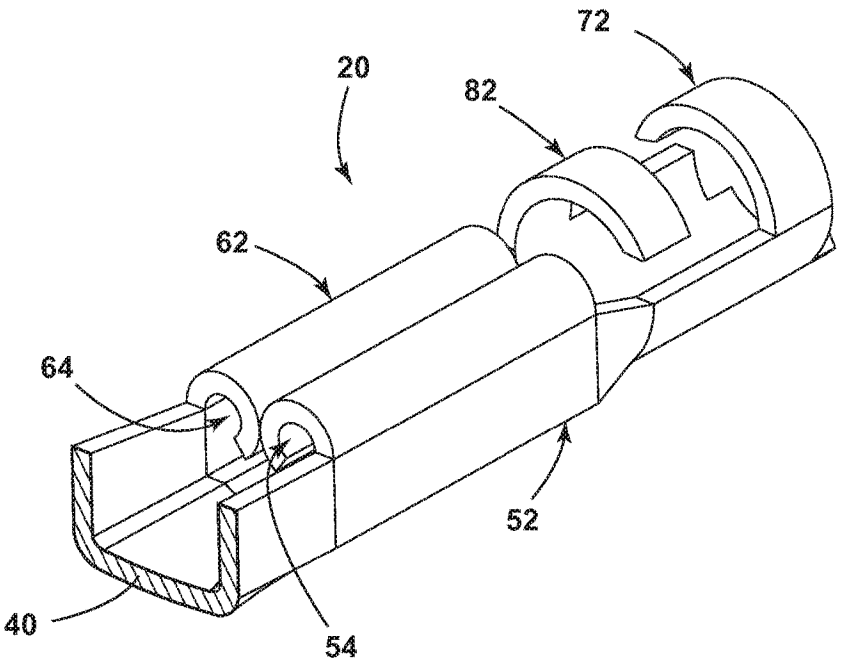
FIG. 6C is a perspective view generally illustrating portions of an embodiment of a terminal after crimping, with a wire hidden.
Figure 6D:
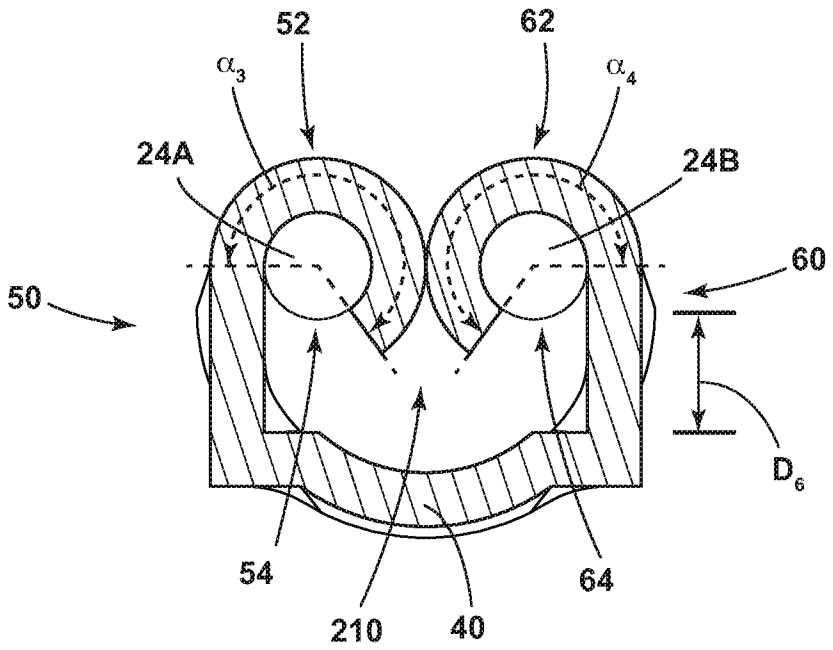
FIG. 6D is a cross-sectional view generally illustrating portions of an embodiment of a terminal assembly after bending.

In embodiments, such as generally illustrated in FIGS. 6C and 6D, in a third state of a terminal 20, the first bent portion 52 may not be in contact with an inside surface of the first wing 50 and/or the body portion 40. The second bent portion 62 may or may not be in contact with an inside surface of the second wing 60 and/or the body portion 40. An outside surface of the first bent portion 52 may be in contact with an outside surface of the second bent portion 62 (e.g., see FIGS. 6A, 6B, 6C, and 6D). The third bent portion 72 and the fourth bent portion 82 may be offset longitudinally, such as to not contact each other in the third state (e.g., there may be a gap 94 between the third bent portion 72 and the fourth bent portion 82).

With embodiments, such as generally illustrated in FIG. 6D, crimping a terminal 20 (e.g., in step 116) may include bending wings 50, 60, such as to a greater degree than with the bending in step 110. Crimping may include bending bent portion 52, 62, which may close channels 54, 64, at least to some degree, relative to a post-bending state of channels 54, 64. For example and without limitation, after crimping, angular extents $\alpha_3$, $\alpha_4$ of the first bent portion 52 and/or the second bent portion 62 may be at least 180 degrees, less than 270 degrees, less than 250 degrees, between 180 degrees and 270 degrees, and/or between 220 degrees and 250 degrees, among others. First wing 50 may extend (e.g., circumferentially) partially or entirely around at least one section (e.g., part or the entire length of) the first portion 24A. For example and without limitation, the first wing 50 may extend circumferentially around at least 50% of the first portion 24A and/or around less than 75% of the first portion 24A. The second wing 60 may extend circumferentially around at least 50% of the second portion 24B and/or around less than 75% of the second portion 24B.

In embodiments, in a third state of a terminal 20, a first wire portion 24A may be retained at least partially within a first channel 54 and/or a second wire portion 24B may be retained at least partially within a second channel 64. In a crimped state/configuration, the first wing, 50, the second wing 60, and the terminal body portion 40 may define a channel 210 that may be substantially closed. The channel 210 may include one or more of a variety of shapes, sizes, and/or configurations. For example and without limitation, the channel 210 may be substantially triangular, circular, rectangular, or oval-shaped. The channel 210 may be disposed below the first wing 50, the channel 54, the first wire portion 24A, the second wing 60, the channel 64, and/or the second wire portion 24B. In embodiments, the wire 24 may be in contact with an inner surface of the wings 50, 60. The channels 54, 64 may be separate from each other, such as in a transverse direction T.

With embodiments, such as generally illustrated in FIGS. 6A, 6B, and 6D, the wire 24 may be inserted into a terminal 20 such that the first wire portion 24A is disposed at least partially in the first channel 54 and/or such that the second wire portion 24B is disposed at least partially in the second channel 64. The second wire portion 24B may extend from the first wire portion 24A. The first portion 24A and the second wire portion may form a looped portion 24E. The looped portion 24E may be disposed outside of the first channel 54 and/or the second channel 64, and may be disposed longitudinally beyond the first wing 50 and/or the second wing 60 (e.g., in a direction away from the third wing 70 and the fourth wing 80). As generally illustrated in FIG. 6D, the loop portion 24E may not be in contact with the terminal body portion 40, the first wing 50, and/or the second wing 60 (e.g., the wire 24 and/or the loop portion 24E may be disposed at a distance $D_6$ above a bottom wall 42 of the terminal body 40). The distance $D_6$ may, for example and without limitation, be at least half of a diameter of the wire 24.

Various embodiments are described herein for various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments.

Reference throughout the specification to "various embodiments," "with embodiments," "in embodiments," or "an embodiment," or the like, means that a particular feature, structure, or characteristic described in connection with the embodiment is included in at least one embodiment. Thus, appearances of the phrases "in various embodiments,"

"with embodiments," "in embodiments," or "an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment/example may be combined, in whole or in part, with the features, structures, functions, and/or characteristics of one or more other embodiments/examples without limitation given that such combination is not illogical or non-functional. Moreover, many modifications may be made to adapt a particular situation or material to the teachings of the present disclosure without departing from the scope thereof.

It should be understood that references to a single element are not necessarily so limited and may include one or more of such element. Any directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of embodiments.

Joinder references (e.g., attached, coupled, connected, and the like) are to be construed broadly and may include intermediate members between a connection of elements and relative movement between elements. As such, joinder references do not necessarily imply that two elements are directly connected/coupled and in fixed relation to each other. The use of "e.g." in the specification is to be construed broadly and is used to provide non-limiting examples of embodiments of the disclosure, and the disclosure is not limited to such examples. Uses of "and" and "or" are to be construed broadly (e.g., to be treated as "and/or"). For example and without limitation, uses of "and" do not necessarily require all elements or features listed, and uses of "or" are intended to be inclusive unless such a construction would be illogical.

While processes, systems, and methods may be described herein in connection with one or more steps in a particular sequence, it should be understood that such methods may be practiced with the steps in a different order, with certain steps performed simultaneously, with additional steps, and/or with certain described steps omitted.

It is intended that all matter contained in the above description or shown in the accompanying drawings shall be interpreted as illustrative only and not limiting. Changes in detail or structure may be made without departing from the present disclosure.

What is claimed is:

1. A terminal assembly, comprising:

a body;

a wire;

a first wing extending from the body and crimped around a first portion of the wire; and a second wing extending from the body and crimped around a second portion of the wire, the second portion extending from the first portion;

wherein the first wing and the second wing are configured to limit movement of the wire; and the first wing and the second wing are configured to retain the first portion and the second portion of the wire at a distance from the body.

2. The terminal assembly of claim 1, wherein the first wing extends circumferentially around at least 50% of the first portion, and the second wing extends circumferentially around at least 50% of the first portion.

3. The terminal assembly of claim 2, wherein the first wing extends circumferentially around less than 75% of the first portion, and the second wing extends circumferentially around less than 75% of the first portion.

4. The terminal assembly of claim 1, wherein the first wing provides a first channel; the second wing provides a second channel; and the first channel and the second channel are spaced from a bottom of the body.

5. The terminal assembly of claim 4, wherein the first portion is disposed partially in the first channel, the second portion is disposed partially in the second channel, and the first portion and the second portion form a loop portion of the wire disposed outside of the first channel and the second channel.

6. The terminal assembly claim 1, wherein the distance is at least as great as a diameter of the wire.

7. The terminal assembly claim 1, wherein the distance is at least half of a diameter of the wire.

8. The terminal assembly of claim 1, wherein the wire is an electrical wire.

9. The terminal assembly of claim 1, wherein the wire is a carbon nanotube wire.

10. The terminal assembly of claim 1, wherein the wire includes a loop portion not in contact with the first wing, the second wing, or the body.

11. A method of connecting a terminal to a wire, the method comprising:

providing a terminal, the terminal including a body, a first wing extending from the body, and a second wing extending from the body and opposite the first wing;

bending the first wing and the second wing to provide a first channel and a second channel such that a gap is present between the first wing and the second wing;

inserting a wire in the first channel and the second channel; and crimping, after bending, the first wing and the second wing with the wire wherein, after bending, the first wing includes a bent portion having an angular extent of between 90 degrees and 150 degrees; and, after crimping, the angular extent of the bent portion is between 180 degrees and 270 degrees.

12. The method of claim 11, wherein the wire is a carbon nanotube wire.

13. The method of claim 11, wherein inserting the wire includes inserting the wire through the first channel of the first wing, then inserting the wire through the second channel of the second wing.

14. The method of claim 13, wherein the wire is inserted into the first channel of the first wing in a first direction, the wire is inserted into the second channel of the second wing in a second direction, and the first direction is opposite the second direction.

15. The method of claim 11, wherein the terminal includes a third wing and a fourth wing; and the third wing and the fourth wing are both configured to contact a first portion of the wire and a second portion of the wire.

16. A method of connecting a terminal to a wire, the method comprising:

providing a terminal, the terminal including a body, a first wing extending from the body, and a second wing extending from the body and opposite the first wing;

bending the first wing and the second wing to provide a first channel and a second channel such that a gap is present between the first wing and the second wing;

inserting a wire in the first channel and the second channel; and crimping, after bending, the first wing and the second wing with the wire;

wherein the terminal includes a third wing and a fourth wing; and the third wing; the fourth wing are both configured to contact a first portion of the wire and a second portion of the wire;

and the first wing, the second wing, the third wing, and the fourth wing are bent during bending via a first die and crimped during crimping via a second die.

17. The method of claim 16, wherein, after bending, the first wing includes a bent portion having an angular extent of between 30 degrees and 180 degrees.

18. The method of claim 17, wherein, after bending, the angular extent of the bent portion is between 90 degrees and 150 degrees.

19. The method of claim 18, wherein, after crimping, the angular extent of the bent portion is between 180 degrees and 270 degrees.

20. A method of connecting a terminal to a wire, the method comprising:

providing a terminal, the terminal including a body, a first wing extending from the body, and a second wing extending from the body;

bending the first wing and the second wing to provide a first channel and a second channel;

inserting a wire in the first channel and the second channel; and crimping, after bending, the first wing and the second wing with the wire;

wherein, after crimping, the wire is disposed at a distance from the body.

* * * * *